United States Patent [19]

Schniter

[11] Patent Number: 4,625,952

[45] Date of Patent: Dec. 2, 1986

[54] SIGNATURE INSERTER

[75] Inventor: Jorg Schniter, Glenview; Thomas Kozyra, Burbank; Ronald Hastie, Elk Grove Village, all of Ill.

[73] Assignee: R. R. Donnelley & Sons, Chicago, Ill.

[21] Appl. No.: 839,452

[22] Filed: Mar. 11, 1986

Related U.S. Application Data

[63] Continuation of Ser. No. 757,634, Jul. 22, 1985, abandoned.

[51] Int. Cl.[4] ..... B65H 39/02

[52] U.S. Cl. ..... 270/54; 271/82; 271/309

[58] Field of Search ..... 270/54–55, 270/57–58; 271/5, 11, 82, 90, 93, 97, 109, 123, 271/287, 309

[56] References Cited

U.S. PATENT DOCUMENTS

| | | | |
|---|---|---|---|
| 2,413,358 | 12/1946 | Kleineberg | 270/54 |
| 2,626,074 | 1/1953 | Vogt | 270/54 |
| 2,819,075 | 1/1958 | Noon | 271/97 |
| 2,855,195 | 10/1958 | Young | 270/54 |
| 3,544,097 | 12/1970 | Linden | 270/54 |
| 3,565,422 | 2/1971 | McCain | 270/11 |
| 3,809,384 | 5/1974 | Zugel | 270/54 |
| 3,880,419 | 4/1975 | Swanson | 271/6 |
| 4,241,907 | 12/1980 | McCain et al. | 270/54 |
| 4,350,327 | 9/1982 | Muller | 270/54 |

FOREIGN PATENT DOCUMENTS

| | | | |
|---|---|---|---|
| 2506532 | 9/1975 | Fed. Rep. of Germany | 271/309 |

OTHER PUBLICATIONS

"Floating Finger/Puffer Paper Stripper" *Xerox Disclosure Journal*, vol. 1, No. 1, Jan. 1976, p. 85.

*Primary Examiner*—E. H. Eickholt
*Attorney, Agent, or Firm*—Wood, Dalton, Phillips, Mason & Rowe

[57] ABSTRACT

A high speed signature inserter packer box to operate with a saddle stitcher at a rate in excess of 225 books per minute includes a very simple and rapid way to convert from operation with a feed hopper signature supply to operation with a stream feeder signature supply. The inserter packer box also has a novel arrangement for controlling the trailing end portion of a signature on the extracting drum in the area where it is grasped by the transfer drum grippers. A low volume, low velocity air stream blows through said area toward the transfer drum to deflect the trailing end portion into a recess in the transfer drum periphery that carries a set of grippers, and the recess is shaped to assure that the deflected trailing end portion is positioned to be grasped by the grippers.

20 Claims, 5 Drawing Figures

SIGNATURE INSERTER

This application is a continuation of application Ser. No. 757,634, filed July 22, 1985 and now abandoned.

IMPROVED SIGNATURE INSERTER

The invention relates to a high speed signature inserter to gather books for a saddle stitcher at a cyclic rate exceeding 225 books per minute; and in addition to its high speed the apparatus is readily adjusted to receive signatures either from a feed hopper, as illustrated in Kleineberg Pat. No. 2,413,358, or from a stream feeder similar to that of Swanson U.S. Pat. No. 3,880,419.

BACKGROUND OF THE INVENTION

Many large circulation periodicals and great numbers of mail order catalogs and large distribution advertising pieces consist of signatures, often with return card inserts, which are gathered on an inserter for saddle stitching, trimming, bundling for minimum shipping costs, and shipping. For present purposes all such publications can be referred to as "saddle stitched books".

The high volume of saddle stitched books presently produced by the U.S. printing industry requires that the most efficient possible use be made of manpower, equipment and plant space. A typical inserter has 32 packer boxes, each of which receives signatures seriatim from a signature supply means, opens each signature, and drops the signatures successively straddling a gathering chain that runs in front of the packer boxes and carries the complete collections of gathered signatures to the saddle stitcher.

The need for highly efficient plant operations results in a constant effort to increase the speed at which inserters and saddle stitchers operate, and their reliability so as to minimize shutdowns due to malfunctions. It is obvious that as machines operate at higher and higher cyclic rates the possibility of malfunctions increases.

Demands for increased plant efficiency are pushing the cyclic rate of bindery lines up from the vicinity of 150 books a minute to a present target figure of about 300 books a minute. Such an enormous increase in the speed of operation necessarily requires the development of new techniques for handling the signatures at all stages of the binding process. High speed operation of packer boxes and a gathering chain presents some particularly difficult problems produced by the need for the inserter to handle signatures that may vary from four pages to 32 pages, and that may consist of a variety of different paper stocks that have varying handling and feeding characteristics. The very high speed handling of paper presents problems that are unknown at lower speeds.

An advance in the rate of bindery operation is illustrated by a comparison between Kleineberg Pat. No. 2,413,358 and McCain Pat. No. 3,565,422. In Kleineberg an extracting drum has two sets of signature grippers and a transfer drum and opener drum each have one set of grippers. In McCain the extracting drum has three sets of grippers and the transfer drum and the opener drum each have two sets. Obviously if the McCain transfer drum and opener drum are driven at the same RPM as those of Kleineberg, the inserter feeds twice as many signatures per minute to the gathering chain.

The basic operation of an inserter has not changed from that disclosed in Pat. No. 2,413,358. An extracting drum has a movable jaw that receives the closed end of a signature and the rotation of the extracting drum carries the signature around to a point where its closed end abuts a register stop and its open end is opposite grippers on a transfer drum. The extracting drum jaws open, the transfer drum grippers close on the open end of the signature and rotation of the transfer drum strips the signature from the extracting drum. Standard practice in saddle stitching requires the use of lap signatures—i.e. those in which one sheet of the signature (the lap sheet) is wider than is the other sheet of the signature.

The gripper means on the transfer drum initially grip both the lap sheet and the short sheet, and when the gripped signature margins are confronting an opener drum the short sheet is released while the lap sheet remains gripped, whereupon the short sheet is gripped by a clamp on the opener drum so that the continuing rotation of the transfer drum and the opener drum spreads the signature to drop it straddling the gathering chain.

It is quite apparent that as the rotational speeds of the three drums increase, the behavior of the free edges of the signatures on the extracting drum also changes. A persistent problem in high speed operation of an inserter is that of controlling the trailing open end portion of the signature so that it is properly gripped by the grippers of the transfer drum. Increased rotational speed of the extracting drum increases the centrifugal force tending to swing the trailing end of the signature away from the drum, and it also greatly changes air turbulence effects that result from proximity of the drum surface to a concentric guide shoe and also from the irregularities in the drum surface produced by the jaw clamps, register stops, and malfeed detectors.

Overall plant efficiency can be increased both by higher cyclic rates of operation and by reducing the time required to make any necessary changes or adjustments in the apparatus to go from one job to the next or to switch from one type of signature supply means to another. Comparison of FIG. 1 of Swanson Pat. No. 3,880,419 with FIG. 2 of McCain Pat. No. 3,565,422 shows that the extracting drum receives signatures from the feed hopper at a totally different point in its rotation from that at which it receives signatures from a stream feeder.

SUMMARY OF THE INVENTION

The present invention has as its principal purpose the more efficient use of manpower and equipment in the operation of a high speed signature inserter.

A principal feature of the present apparatus is that it utilizes an air stream to maintain control over the trailing end portion of a signature in the area where it is gripped by the transfer drum gripper means. The effectiveness of the air stream is enhanced by the particular shape of a recess in the periphery of the transfer drum in which the grippers are mounted.

Another major feature of the apparatus is the ease and rapidity with which it may be converted from operation with a manually loaded feed hopper to operation with a stream feeder.

In the present apparatus, a guide shoe that is concentric with a portion of the periphery of the extracting drum has an end that terminates very close to a plane that bisects the extracting drum axis and the transfer drum axis. A short distance to the other side of that plane is a signature form roller that cooperates with the end of the guide shoe to define a gap of predetermined width. Each transfer drum gripper means is positioned in a recess in the periphery of the transfer drum, and each said recess confronts the gap as a trailing end portion of a signature traverses the gap. Air nozzle means directs an air stream through the gap to bend each signature about the form roller and deflect the trailing end portion of the signature into the transfer drum recess to be gripped by the gripper means. In a preferred structure the nozzle means comprises a pair of nozzles flanking the extracting drum.

Each transfer drum recess has a circumferential dimension shorter than the width of the gap, and each recess has a base concentric with the drum surface, a trailing face nearly perpendicular to a chord across the base, and a leading face at substantially a 130° angle to said chord. The leading face is substantially normal to the plane of the air stream when the leading face is directly opposite the nozzle means. A leading outer face extends from the outer end of the leading face in a plane substantially perpendicular to that of the trailing face and intersects the circumferential surface of the transfer drum.

Rapid and easy adjustment of the inserter for use either with a feed hopper or with a stream feeder is accomplished by mounting the suction cups that transfer signatures seriatim from the supply means to the extracting drum upon a frame which is rotatably adjustable about the axis of the extracting drum between a first position where a feed hopper is used and a second position where a stream feeder is used. An adjustable cam that controls the extracting drum jaws is also mounted upon the frame. A guide plate on the frame is predominantly upright in the first position of the frame and is predominantly horizontal in the second position of the frame so that, in each position, it cooperates with the signature supply means to position signatures for reception by the extracting drum jaw means.

Cam means that control operation of the suction grippers are mounted for rotation about the axis of the extracting drum and are operatively connected to a rotatable driven cam drive member. The cam drive member has a first plate that is fixed to a shaft and a second plate that is rotatable independently of the first plate, and means are provided for fixing the second plate to the first plate in either of two positions. The operative connection of the driven member to the cam means is from the second plate, so that indexing of the second plate also adjusts the cams to coordinate suction gripper operation with the position at which signatures are received by the extracting drum.

The inserter packer box is provided with a first mounting member that supports the forward portion either of a supply hopper or a stream feeder, a second mounting member that supports a rearward portion of only the feed hopper, and a third mounting member that supports only the rearward portion of a stream feeder.

To shift from feed hopper operation to stream feeder operation, the feed hopper is lifted off the first and second supports by an overhead crane and a stream feeder is positioned upon the first and third supports by an overhead crane. The location of the supports properly orients each unit to the extracting drum.

The frame is then adjusted to reposition the guide plate, the suction means and the extracting drum jaw cams; and the cam drive member is manually indexed to rotate the suction gripper control cams.

THE DRAWINGS

DETAILED DESCRIPTION OF THE INVENTION

Figure 1:
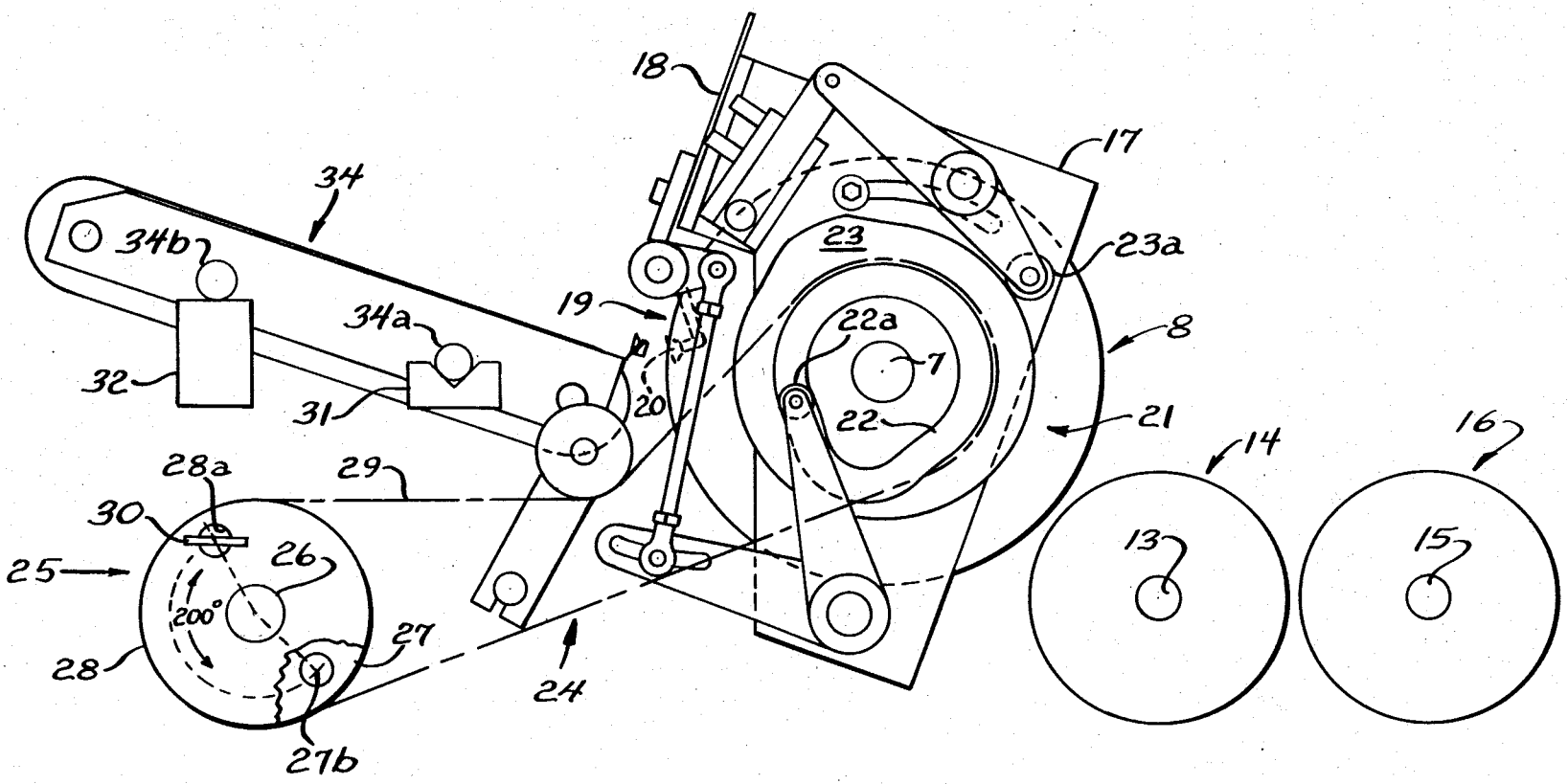
FIG. 1 is a schematic side elevational view of a signature inserter packer box adjusted for operation with a feed hopper, and with the feed hopper in place.
Figure 2:
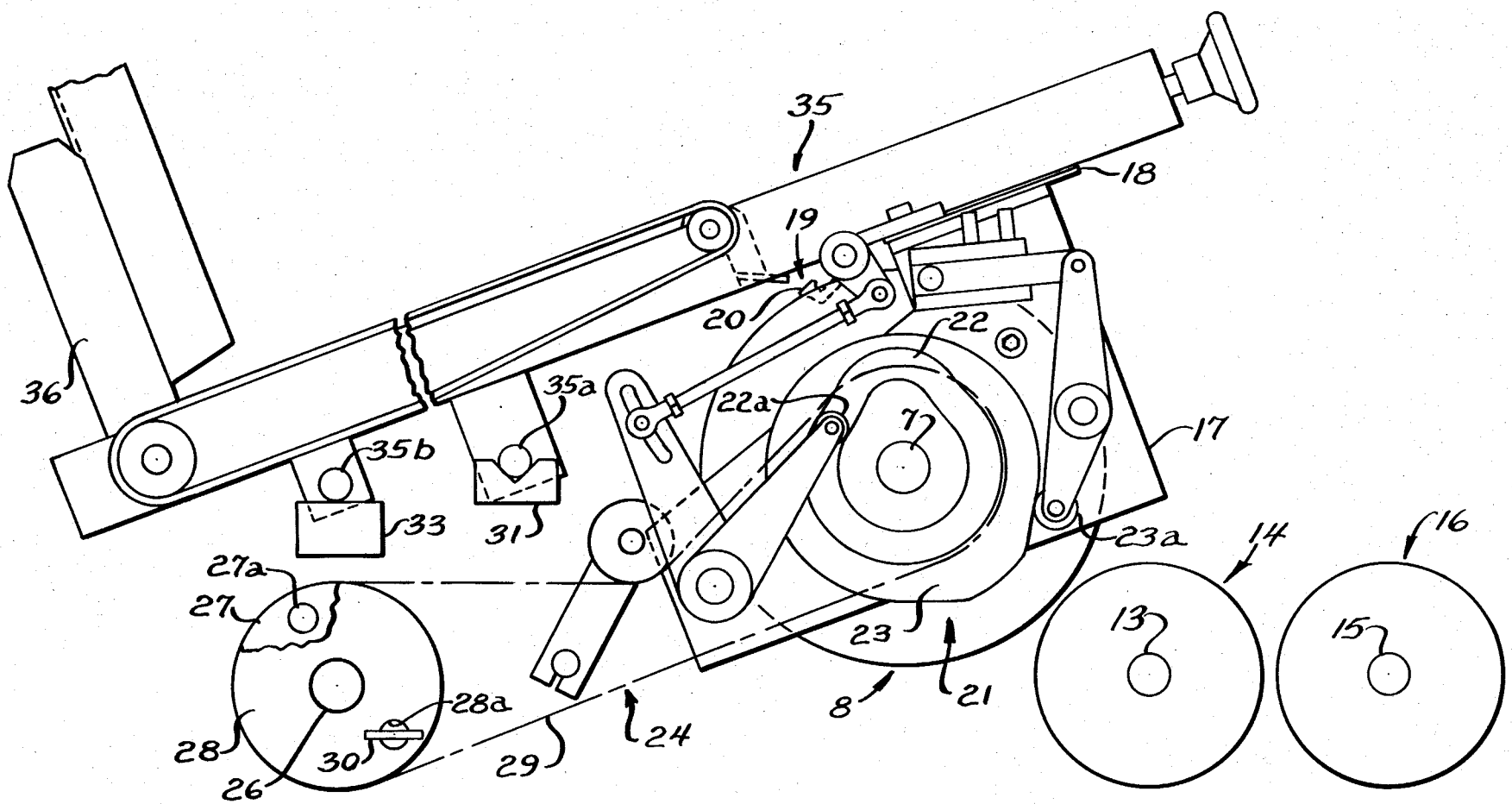
FIG. 2 is a view like FIG. 1 with the packer box adjusted for stream feeder operation and with the stream feeder in place.
Figure 3:
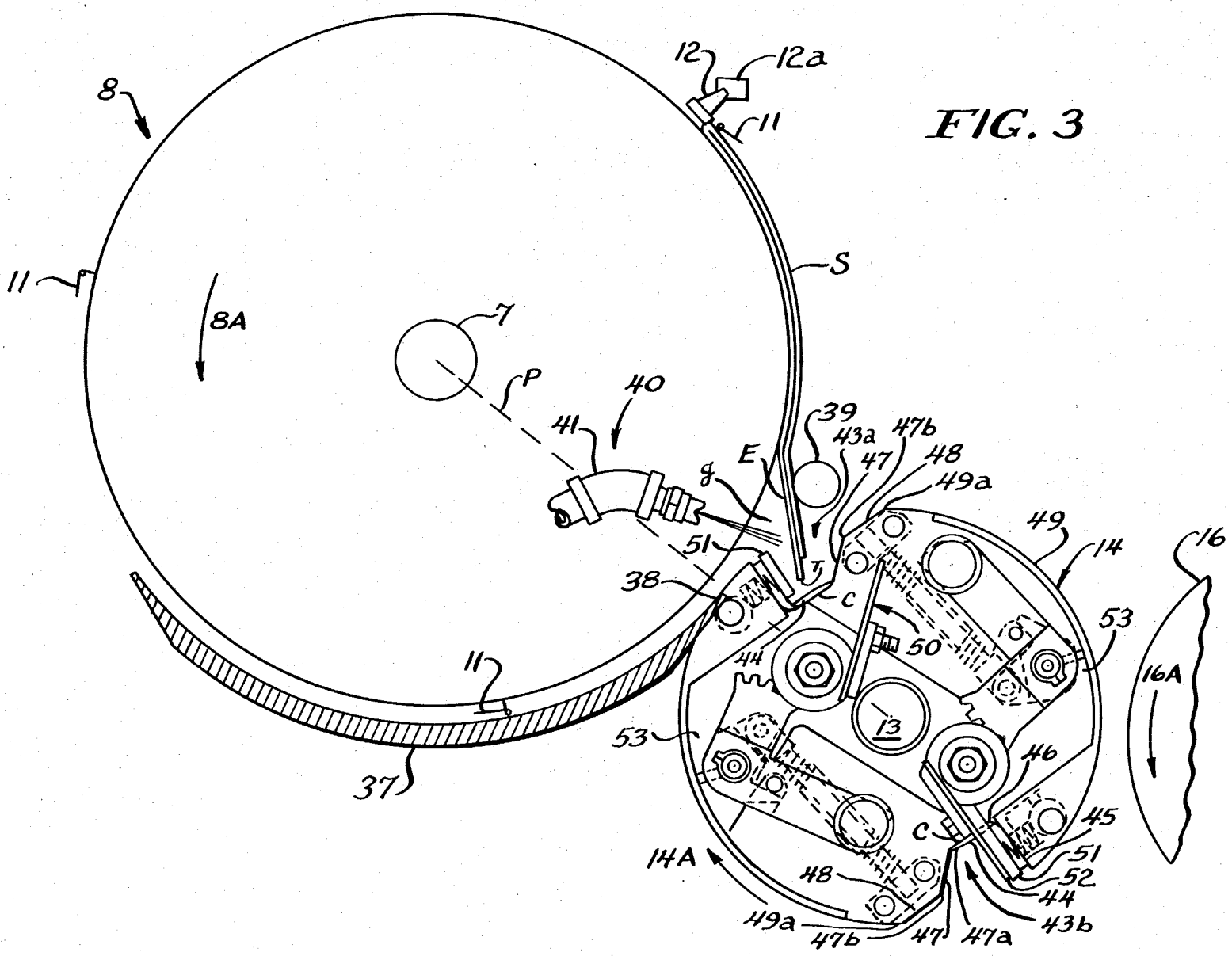
FIG. 3 is a fragmentary schematic view of the extracting drum, transfer drum, guide shoe, signature form roller and air nozzle means.
Figure 4:
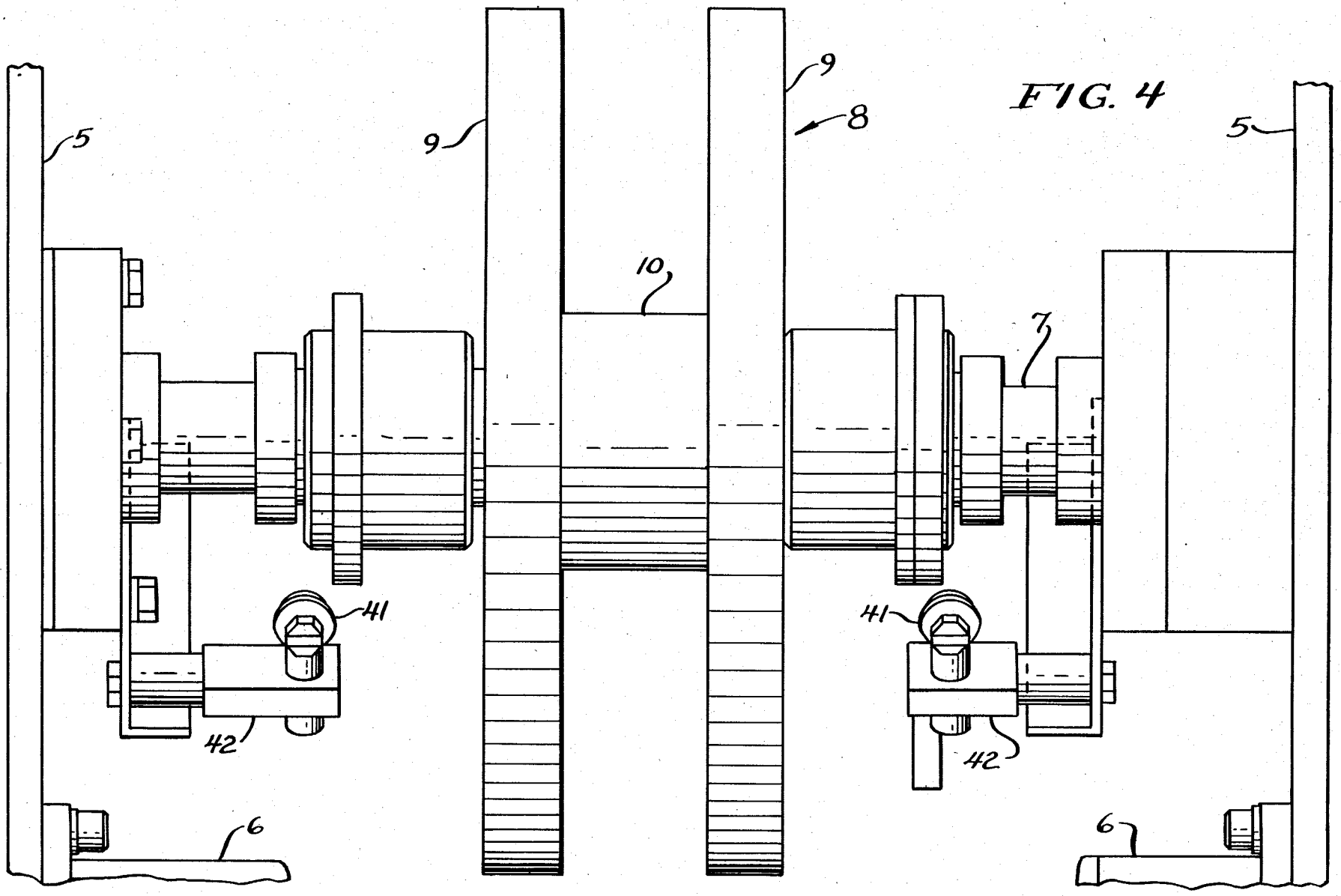
FIG. 4 is a schematic transverse sectional view that shows the location of the air nozzles relative to the extracting drum, the transfer drum being omitted for clarity of illustration.

Referring to the drawings in detail, and referring first to FIGS. 1, 2 and 4, the signature inserter packer box of the present invention has a frame that includes side plates 5 and a plurality of cross members such as the member 6. A rotatable extracting drum shaft 7 provides a first axis about which an extracting drum 8 rotates in the direction of the arrow 8A in FIG. 3. The extracting drum consists of a pair of spaced discs 9 on opposites sides of a hub 10, and the extracting drum has arranged about its periphery three jaws 11 which are indicated schematically in FIG. 3. A register stop 12 is mounted adjacent the drum 89 on a quadrant **12*a*** so that it may be adjusted circumferentially to accommodate the apparatus to signatures S of different lengths.

Also mounted between the frame side plates 5 is a transfer drum shaft 13 that provides a second axis about which a driven transfer drum, indicated generally at 14, rotates in the direction of the arrow 14A. An opener drum shaft 15 provides a third axis about which an opener drum 16 rotates in the direction of the arrow 16A.

FIGS. 1 and 2 show, respectively, a first position and a second position of a mounting frame 17 that is rotatably indexed about the extracting drum shaft 7 to change the location of a guide plate 18, suction means, indicated generally at 19, and an adjustable extracting drum jaw operating cam (not shown). In the first position of the frame the guide plate 18 is predominantly upright, while in the second position of the frame the guide plate is predominantly horizontal.

The suction means 19 includes the usual oscillating suction grippers 20 and suitable valve means for selectively connecting the suction grippers to a source of vacuum.

Also rotatably mounted upon the extracting drum shaft 7 is a cam means, indicated generally at 21, that includes a cam track 22 and follower **22*a* to control oscillation of the suction grippers 20 and a circumferential face cam 23 and cam follower 23*a* to actuate the air valve for said grippers. The cam means is operated by a cam drive, indicated generally at 24**.

A rotatable driven member, indicated generally at 25, is mounted upon a cam shaft 26 and consists of a first plate 27 that is keyed to the cam shaft 26 and a second plate 28 that is rotatable about the cam shaft 26 and that includes peripheral sprocket teeth to receive a drive chain 29 by means of which it is operatively connected to the cam means 21. The first plate 27 is provided with two holes 27*a* and 27*b* while the second plate 28 is provided with a hole 28*a* that may be aligned either with the hole 27*a* or with the hole 27*b* to index the second plate 28. An axially movable pin 30 extends through the hole 28*a* and into either the hole 27*a* or 27*b* in order to permit the second plate 28 to occupy either a first or a second position. Rotation of the second plate 28 relative to the first plate 27 operates through the drive chain 29 to index the cam means 21 correspondingly between a first position and a second position. In the first position of the cam means 21 the suction grippers 20 are operated at the correct time for use with a feed hopper, while in the second position of the cam means 21 they are correctly operated for use with a stream feeder.

Mounted upon the side plates 5 are a first mounting member 31 comprising a pair of aligned V cradles, a second mounting member 32 consisting of a pair of aligned blocks, and a third mounting member 33 that also consists of a pair of aligned blocks. FIG. 1 shows that a feed hopper 34 has round forward mounting bars 34*a* that seat in the V cradles of the first mounting member 31, and FIG. 2 shows that the stream feeder 35 has forward mounting bars 35*a* that also seat in the V cradles of the first mounting member. Rearward mounting bars 34*b* on the feed hopper rest on top of the blocks that form the second mounting member 32, and rear mounting bars 35*b* on the stream feeder rest on the blocks that form the third mounting member 33. The V cradles, of course, serve to locate the forward ends of the feed hopper and of the stream feeder precisely with reference to the extracting drum 8. The relative positions of the second mounting member 32 and the first mounting member 31 sets the feed hopper 34 at the correct angle for operation with the extracting drum 8, and similarly the position of the third mounting member 33 relative to the first mounting member 31 positions the stream feeder 35 at the correct angle for operation.

As is well known in the art, the feed hopper 34 holds a supply of signatures in a generally upright position with their closed ends down, and may be loaded by hand or by any appropriate transfer mechanism known to the art. The stream feeder 35 has a signature magazine 36 at its outer end portion to accommodate a large supply of signatures that are fed from the the supply in the form of a shingled stream that automatically replenishes a small stack of signatures as taught in Swanson Pat. Nos. 3,522,943 and 3,880,419. The large signature supply may be generally upright as shown in the Swanson patents, or it may be in a different orientation, so long as a shingled stream is formed to replenish a small stack as taught in those patents.

As previously stated in the general description of the invention, an overhead crane can be used to lift either of the signature supply means 34 or 35 from the mounting members upon which it is supported and replace it with the other of the two types of supply means.

Referring now particularly to FIG. 3, a guide shoe 37 is seen to be concentric with a portion of the periphery of the extracting drum 8, and an end 38 of the guide shoe is positioned very close (in practice about ⅛ inch, 3.175 mm) from a plane through the first axis provided by the extracting drum shaft 7 and the second axis provided by the transfer drum shaft 13. Said plane is indicated by a broken line p in FIG. 3. A short distance to the other side of the plane p is a signature form roller 39 that cooperates with the end 38 of the guide shoe to define a gap g.

Nozzle means, indicated generally at 40 in FIG. 3, is seen in FIG. 4 to consist of a pair of nozzles 41 that are supported upon brackets 42 on the side plates 5 so that the nozzles 41 flank the extracting drum discs 9. Each of the nozzles 41 has about a 1/6 inch (4.2 mm) opening and is continuously provided with air at a pressure of about 5 psi, so that the nozzle means 40 provides a relatively low velocity and small volume air stream through the gap g.

Figure 5:
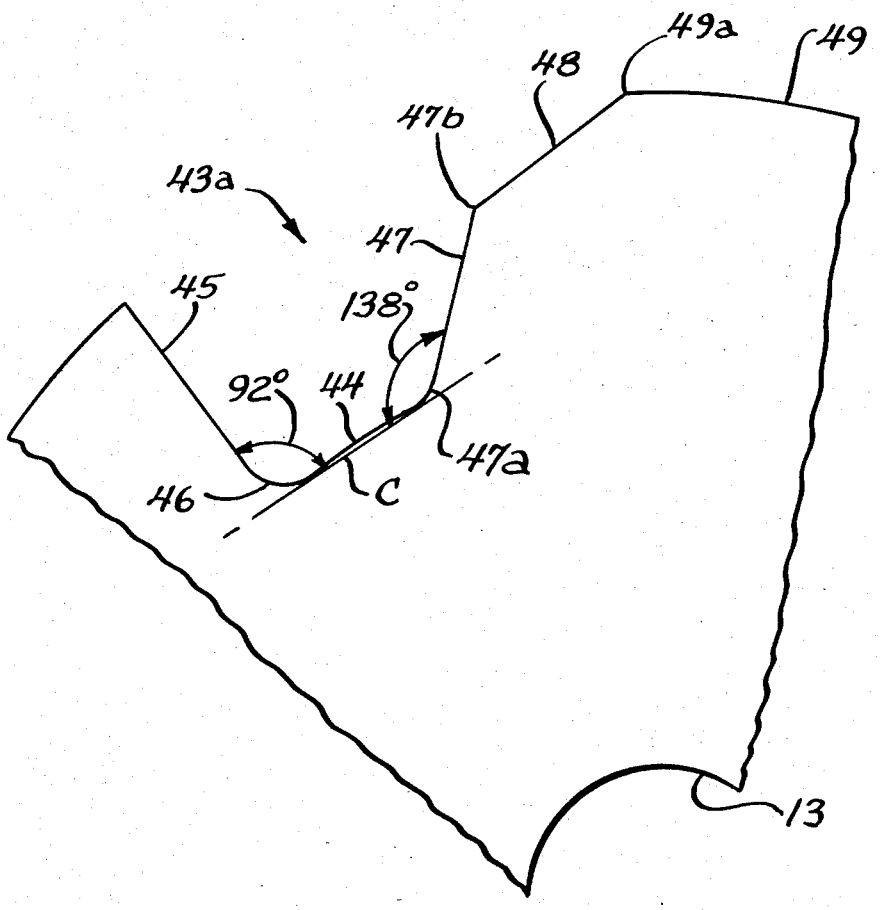
FIG. 5 is a fragmentary schematic view on an enlarged scale, illustrating the transfer drum recess in detail.

The transfer drum 14 is seen in FIG. 3 to have recesses, indicated generally at 43*a* and 43*b*, that are at opposite sides of a circumferential surface 49 of the drum. The shape of the recesses 43 is critical to the successful operation of the apparatus, and is best seen in FIG. 5. Each recess has a base 44 concentric to the drum surface 49. A trailing face 45 of each recess is at an angle of about 92° to a chord c across the base 44 of the recess and is connected to said base by an arcuate surface 46. A leading face 47 of the recess is at substantially a 138° angle to the chord c and is connected to the base 44 by an arcuate surface 47*a*. The angle between the plane of the trailing face 45 and the plane of the leading face 47 is substantially. A leading outer face 48 extends from an outer end 47*b* of the leading face 47 in a plane substantially perpendicular to that of the trailing face 45 and intersects the circumferential surface 49 of the transfer drum along a line 49*a*. The leading face 47 is seen to be substantially normal to the plane of the air stream when said leading face is directly opposite the nozzle means 40.

Specific dimensions of the transfer drum 14 are as follows:

radius of drum 14: 3.5 in. (88.9 mm)
radius of recess base 44: 2.375 in. (6.0325 mm)
radius to line 47*b*: 3.125 in. (7.9375 mm)
length of leading outer face 48 from 47*b* to 49*a* 0.84375 in. (2.143125 mm)
planar length of leading face 47: approx. 0.78125 in. (19.84375 mm)
planar length of trailing face 45: approx. 0.84375 in. (21.43125 mm)
arc of recess 43 along drum surface 49 from 45 to 49*a*: 40°
arc from line 47*b* to face 45, concentric to drum surface 49 28°
radii of curvature at 46 and 47*a*: 0.25 in. (6.35 mm)

In each of the transfer drum recesses 43*a* and 43*b* is gripper means 50 that includes a rear gripper seat 51 mounted upon the trailing face 45 of the recess and cushioned by a compression spring, and forward gripper leaf means, indicated generally at 52. The rear gripper seat 51 has a gripping face that is in a plane perpendicular to that of the chord c. The gripper leaf means 52 is moved by cam operated rack and pinion mechanisms, indicated generally at 53, to swing between the open position seen at the recess 43*a* and a closed position seen at the recess 43*b*. Each of the cam operated rack and pinion mechanisms 53 includes a compression spring that biases the rack and pinion mechanism in a direction to open the gripper leaf means 52. The gripper means 50 is generally conventional, and in practice the forward gripper leaf means 52 actually consists of two independently operated leaves, one of which grips the lap sheet of the signature and the other of which grips the short sheet of the signature, as previously described in the "Background of the Invention".

The extracting drum register stop 12 is adjustable about the circumference of the extracting drum 8 so as to accommodate signatures that are of different lengths from the closed end to the open end. The position of the register stop 12 is adjusted so that it controls the precise point in the machine cycle at which a signature S has its trailing end T pass beyond the end 38 of the guide shoe 37 and into the gap. An end portion E of the signature is below the signature form roller 39 as seen in FIG. 3 so that it is hanging in the gap, and the air stream produced by the nozzle means 40 bends the signature S about the form roller 39 and deflects the trailing end portion E of the signature into the recess 43 to be gripped by the gripper means 50.

One of the most advantageous characteristics of the air stream provided by the nozzle means 40 is that it deflects the trailing end portion E of a signature into the recess 43 even though that trailing end portion may be somewhat curled either toward or away from the extracting drum 8. It is not at all uncommon for the trailing end portion E of a signature to be curled slightly in one direction or the other, and when that is the case the gripper means 50 is especially likely to miss the entire signature or at least the short sheet of the signature, thus causing a jam that shuts down the entire binding line. The air stream prevents this.

Extended experimental runs of a 16-box inserter in which the boxes are constructed in accordance with the present disclosure has shown that the air nozzle means in combination with the carefully shaped recesses 43 in the transfer drum 14 provides for reliable transfer of signatures at speeds approaching the cyclic rate of 225 books per minute.

The foregoing detailed description is given for clearness of understanding only and no unnecessary limitations should be understood therefrom, as modifications will be obvious to those skilled in the art.

I claim:

1. In a high speed signature inserter to gather books for a saddle stitcher at a cyclic rate exceeding 225 books per minute, said inserter including a driven gathering chain, a signature supply means, a driven rotary extracting drum on a first axis, a guide shoe concentric with a portion of the periphery of the extracting drum, a plurality of movable jaw means disposed about the periphery of the extracting drum to grasp signatures from said supply seriatim with their closed ends leading, an adjustable register stop adjacent the periphery of the extracting drum which controls when a trailing open end of a signature passes beyond an end of the guide shoe, a driven rotary transfer drum on a second axis, a plurality of gripper means disposed about the periphery of the transfer drum to grip the trailing end of each signature and strip the signature from the extracting drum, and an opener drum on a third axis, said opener drum cooperating with the transfer drum to open signatures and drop them successively straddling the gathering chain, the improvement comprising:

a signature form roller adjacent said end of the guide shoe and cooperating therewith to define a gap of predetermined width;

a recess in the periphery of the transfer drum in which each gripper means is positioned, each said recess confronting said gap as a trailing end portion of a signature traverses the gap;

and air nozzle means that directs an air stream through the gap to bend each signature about the form roller and deflect the trailing end portion of the signature into the recess to be gripped by the gripper means.

2. The improvement of claim 1 in which each recess in the periphery of the transfer drum has a circumferential dimension shorter than the width of the gap.

3. The improvement of claim 2 in which each recess has a leading face that is substantially normal to the plane of the air stream when said leading face is directly opposite the nozzle means.

4. The improvement of claim 1 in which each recess has a leading face that is substantially normal to the plane of the air stream when said leading face is directly opposite the nozzle means.

5. The improvement of claim 1 in which the nozzle means comprises a pair of nozzles flanking the extracting drum.

6. The improvement of claim 1 in which each recess has a base concentric with the transfer drum surface, a trailing face substantially perpendicular to a chord across said base, a leading face at substantially a 138° angle to said base, and a leading outer face extending from the outer end of the leading face in a plane substantially perpendicular to that of the trailing face and intersecting the circumferential surface of the transfer drum.

7. The improvement of claim 6 in which the leading face of each recess is substantially normal to the plane of the air stream when said leading face is directly opposite the nozzle means.

8. The improvement of claim 7 in which said end of the guide shoe is extremely close to one side of a plane through the first and second axes, and the form roller is on an axis a short distance to the other side of said plane.

9. The improvement of claim 6 in which there is a curve of small radius between the base and the trailing face.

10. The improvement of claim 1 in which said end of the guide shoe is extremely close to one side of a plane through the first and second axes, and the form roller is on an axis a short distance to the other side of said plane.

11. The improvement of claim 1 that includes a frame which is rotatably adjustable about the axis of the extracting drum between a first position and a second position, a guide plate on said frame that cooperates with the signature supply means to position signatures for reception by the jaw means of the extracting drum, said guide plate being predominantly upright in the first position of the frame and being predominantly horizontal in the second position of the frame, cam means mounted for rotation about the axis of the extracting drum, suction means for shifting signatures seriatim from the supply means to the jaw means of the extracting drum, said suction means being mounted on the frame and including control valves operated from said cam means, a cam drive including a rotatable driven member operatively connected to the cam means, and means for rotating the rotatable driven member and the cam means between first and second positions corresponding with the first and second positions of the frame, whereby operation of the control valves may be coordinated with the guide plate and suction means positions to shift signatures from either of two alternative signature supply means.

12. The improvement of claim 11 in which the signature supply means comprises a feed hopper that cooperates with the guide plate in the first position of the frame.

13. The improvement of claim 11 in which the signature supply means comprises a stream feeder that moves signatures in a shingled stream from a large supply of signatures, said stream feeder cooperating with the guide plate in the second position of the frame.

14. In a high speed signature inserter to gather books for a saddle stitcher at a cyclic rate exceeding 225 books per minute, said inserter including a driven gathering chain, a signature supply means, a driven rotary extracting drum on a first axis, a plurality of movable jaw means disposed about the periphery of the extracting drum to grasp signatures from said supply means seriatim with their closed ends leading, cam means mounted for rotation about the axis of the extracting drum, suction means for shifting signatures seriatim from the supply means to the jaw means of the extracting drum, said suction means including control valves operated from said cam means, and a cam drive including a rotatable driven member operatively connected to the cam means, the improvement comprising:

a frame which is rotatably adjustable about the axis of the extracting drum between a first position and a second position;

a guide plate on said frame that cooperates with the signature supply means to position signatures for reception by the jaw means of the extracting drum, said guide plate being predominantly upright in the first position of the frame and being predominantly horizontal in the second position of the frame;

the suction means are mounted on said frame;

and means for indexing the rotatable driven member and the cam means between first and second positions corresponding with the first and second positions of the frame, whereby operation of the control valves may be coordinated with the guide plate and suction means positions to shift signatures from either of two alternative signature supply means.

15. The improvement of claim 14 in which the signature supply means comprises a feed hopper that cooperates with the guide plate in the first position of the frame.

16. The improvement of claim 14 in which the signature supply means comprises a stream feeder that moves signatures in a shingled stream from a large supply of signatures, said stream feeder cooperating with the guide plate in the second position of the frame.

17. The improvement of claim 14 which includes a first mounting member that supports either of two alternative signature supply means, a second mounting member that supports only a first of said two alternative signature supply means, and a third mounting member that supports only a second of said two alternative signature supply means.

18. The improvement of claim 17 in which the first of said two alternative signature supply means comprises a feed hopper that cooperates with the guide plate in the first position of the frame, and the second of said two alternative signature supply means comprises a stream feeder that moves signatures in a shingled stream from a large supply of signatures, said stream feeder cooperating with the guide plate in the second position of the frame.

19. The improvement of claim 14 in which the driven member comprises a first plate, a second plate rotatable independently of the first plate, and means for fixing said second plate to said first plate in either of said first and second positions, and in which said second plate is operatively connected to the cam means.

20. The improvement of claim 19 in which said last named means comprises a pair of circumferentially spaced holes in the first plate, a hole in the second plate that may be in register with either of said pair of holes, and a pin that extends through said hole and either of said pair of holes.

* * * * *